US011821096B2

(12) United States Patent
Chen et al.

(10) Patent No.: US 11,821,096 B2
(45) Date of Patent: Nov. 21, 2023

(54) DEVICE AND METHOD FOR PREPARING HIGH-PURITY TITANIUM POWDER BY CONTINUOUS ELECTROLYSIS

(71) Applicant: ZHEJIANG HAIHONG HOLDING GROUP CO., LTD., Hangzhou (CN)

(72) Inventors: Haixian Chen, Hangzhou (CN); Jiapei Cao, Hangzhou (CN)

(73) Assignee: ZHEJIANG HAIHONG HOLDING GROUP CO., LTD., Hangzhou (CN)

( * ) Notice: Subject to any disclaimer, the term of this patent is extended or adjusted under 35 U.S.C. 154(b) by 191 days.

(21) Appl. No.: 17/422,453

(22) PCT Filed: Dec. 11, 2019

(86) PCT No.: PCT/CN2019/124492
§ 371 (c)(1),
(2) Date: Jul. 13, 2021

(87) PCT Pub. No.: WO2020/147465
PCT Pub. Date: Jul. 23, 2020

(65) Prior Publication Data

US 2022/0090281 A1 Mar. 24, 2022

(30) Foreign Application Priority Data

Jan. 14, 2019 (CN) ..... 201910030459.9

(51) Int. Cl.
*C25C 7/08* (2006.01)
*C25C 5/04* (2006.01)
*C25C 7/02* (2006.01)

(52) U.S. Cl.
CPC ..... *C25C 7/08* (2013.01); *C25C 5/04* (2013.01); *C25C 7/025* (2013.01)

(58) Field of Classification Search
CPC .... C25C 3/28; C25C 5/00; C25C 5/02; C25C 5/04
See application file for complete search history.

(56) References Cited

U.S. PATENT DOCUMENTS 1,365,140 A * 1/1921 Atkinson ..... C25C 5/02 204/216
2,099,873 A * 11/1937 Sternfels ..... C25C 5/02 204/216

(Continued)

FOREIGN PATENT DOCUMENTS

CN 1712571 A 12/2005
CN 1268791 C 8/2006

(Continued)

OTHER PUBLICATIONS

Machine translation of Zhu et al CN 1712571 A (Year: 2005).*

(Continued)

*Primary Examiner* — Harry D Wilkins, III
(74) *Attorney, Agent, or Firm* — Bayramoglu Law Offices LLC

(57) ABSTRACT

A device and method for preparing high-purity titanium powder by continuous electrolysis are provided. The method includes: electrolyzing a titanium-containing conductive ceramic anode and a rotatable cathode in a fused salt electrolytic tank; continuously transferring titanium powder deposited on a surface of the cathode by the rotatable cathode to a position above the fused salt; scraping the titanium powder by a discharging scraper, and collecting; filtering the titanium powder, and recovering the fused salt; cooling separated titanium powder, washing with deoxygenated and deionized water, and vacuum-drying to obtain final titanium powder. The device includes a fused salt electrolysis mechanism, a continuous titanium powder collection (Continued)

mechanism, a filtering mechanism, a washing mechanism, and a vacuum-drying mechanism.

13 Claims, 1 Drawing Sheet

(56) References Cited

U.S. PATENT DOCUMENTS

| | | | | |
|---|---|---|---|---|
| 2,714,575 | A * | 8/1955 | Wainer | C25C 5/04 205/401 |
| 2,722,509 | A | 11/1955 | Wainer | |
| 2,868,703 | A | 1/1959 | Wainer | |
| 4,028,199 | A * | 6/1977 | Holland | C02F 1/46109 205/610 |
| 4,773,978 | A * | 9/1988 | Thomassen | C25C 7/08 204/224 R |
| 5,336,378 | A | 8/1994 | Nishimura et al. | |
| 2005/0166706 | A1* | 8/2005 | Withers | C22B 34/129 205/560 |
| 2013/0084206 | A1* | 4/2013 | Zhou | C22B 34/1281 205/401 |
| 2016/0222533 | A1* | 8/2016 | Zhu | C25C 3/28 |
| 2018/0127888 | A1* | 5/2018 | Clarke | H01M 4/68 |

FOREIGN PATENT DOCUMENTS

| | | | | |
|---|---|---|---|---|
| CN | 1842617 | A | 10/2006 | |
| CN | 1867702 | A | 11/2006 | |
| CN | 1882718 | A | 12/2006 | |
| CN | 101048518 | A | 10/2007 | |
| CN | 100415940 | C | 9/2008 | |
| CN | 101775626 | A | 7/2010 | |
| CN | 101914788 | A | 12/2010 | |
| CN | 102905820 | A | 1/2013 | |
| CN | 103305875 | A | 9/2013 | |
| CN | 103451682 | A | 12/2013 | |
| CN | 103484898 | A | 1/2014 | |
| CN | 103834969 | A | 6/2014 | |
| CN | 102925930 | B | 11/2015 | |
| CN | 105568320 | A | 5/2016 | |
| CN | 106757167 | A | 5/2017 | |
| CN | 104831318 | B | 2/2018 | |
| CN | 108251866 | A | 7/2018 | |
| CN | 109763148 | A | 5/2019 | |
| EP | 0429748 | A1 * | 6/1991 | C25C 5/02 |
| WO | WO-2017191605 | A1 * | 11/2017 | C25C 1/12 |

OTHER PUBLICATIONS

Machine translation of Heinke EP 0429748 A1 (Year: 1991).*
Yixin Hua, Introduction to nonferrous metallurgy, 2014.
Chongqing Branch of China Institute of Science and Technology Information, Foreign Vanadium and Titanium Series 15: Preparation of Titanium by Electrolysis, 1980.

* cited by examiner

DEVICE AND METHOD FOR PREPARING HIGH-PURITY TITANIUM POWDER BY CONTINUOUS ELECTROLYSIS

CROSS REFERENCE TO THE RELATED APPLICATIONS

This application is the national phase entry of International Application No. PCT/CN2019/124492, filed on Dec. 11, 2019, which is based upon and claims priority to Chinese Patent Application No. 201910030459.9, filed on Jan. 14, 2019, the entire contents of which are incorporated herein by reference.

TECHNICAL FIELD

The present disclosure belongs to the field of non-ferrous metal metallurgy, and specifically relates to a method and a device for preparing high-purity titanium powder by continuous electrolysis.

BACKGROUND

Titanium powder metallurgy makes it possible to achieve low-cost and near-net shape (NNS) manufacturing of metal parts with complex structures. Titanium powder can be first mixed with other metal elements or pre-alloyed, and then consolidated by methods such as metal injection molding (MIM), hot isostatic pressing (HIP), direct powder rolling (DPR), or laser sintering. The quality and cost of titanium powder are vital for the metallurgy product made of titanium powder.

Generally, titanium powder needs to be produced with titanium prepared by the Kroll process as the raw material. The Kroll process is complex and costly; including, chlorinating a $TiO_2$ ore in the presence of carbon to obtain $TiCl_4$ and allowing the obtained $TiCl_4$ to react with magnesium to produce sponge titanium. In the Kroll process, the reduction for $TiCl_4$ and the separation of $MgCl_2$ are time-consuming and expensive batch operations, and it is difficult to improve the purity. The prepared sponge titanium is a porous aggregate with a size of 20 mm to 50 mm, and titanium particles are firmly sintered together so they can hardly be separated mechanically. Therefore, the sponge titanium cannot be directly used for powder metallurgy, and it needs to be purified and then prepared into titanium powder by hydrogenation dehydrogenization (HDH) or atomization.

HDH is a process for preparing titanium powder based on the reversible characteristics of titanium and hydrogen. In the process, formed titanium hydride is brittle so that it can be mechanically crushed into titanium hydride powder, and then the titanium hydride powder is dehydrogenated at a high temperature under vacuum to obtain titanium powder. HDH has been the main method for producing titanium powder at home and abroad since the titanium powder prepared by HDH has a wide particle size range and has low cost and low requirements for raw materials. However, the titanium powder prepared by HDH has relatively high O and N contents.

The atomization for preparing titanium powder includes breaking liquid titanium or alloy stream into tiny droplets, and cooling and solidifying the tiny droplets in an environment to obtain titanium powder. At present, the atomization for preparing titanium powder mainly includes gas atomization and centrifugal atomization, but both have high energy consumption and low production efficiency.

At present, the fused salt electrolysis method for preparing titanium powder is being studied and developed. The FFC-Cambridge process (CN1268791C) was developed by Fray, Farthing, and G. Z. Chen from Cambridge University in England. In the FFC-Cambridge process, $TiO_2$ is directly reduced by an electrochemical method at a cathode in fused $CaCl_2$ to obtain titanium powder. The FFC-Cambridge process is at the industrial scale-up test stage, having problems with the separation of titanium and salt and the pollution of C and Fe. In addition, the FFC-Cambridge process needs to use high-purity $TiO_2$ as the raw material, resulting in a relatively high raw material cost.

The Chinese patent No. CN102905820 discloses a method for continuously producing titanium powder, where $TiCl_4$ (raw material) reacts with liquid magnesium and other reducing agents in a fused salt to prepare titanium powder. In this method, the needed raw material is high-purity $TiC_4$, and a reduction product such as $MgCl_2$ needs to be electrolytically recovered.

Another fused salt electrolysis method for preparing titanium powder includes dissolving a titanium-containing conductive ceramic anode, and then precipitating to obtain titanium powder a cathode. This method was first described in patents such as the U.S. Pat. No. 2,722,509 and the U.S. Pat. No. 2,868,703 in the 1950s. Since 2003, the MER Company in the United States has continued to promote the development of such methods (CN104831318B), with a composite of titanium oxide and carbon as an electrolytic anode. In the Chinese patent No. CN100415940C, a composite of TiO and TiC is used as an anode to prepare titanium by electrolysis. In the Chinese patent No. CN102925930B, a composite of a titanium-containing material and carbon is used as an anode to prepare titanium powder by two-step electrolysis. In these procedures for preparing titanium powder, a composite of titanium oxide with titanium carbide or carbon is sintered into an anode, and the anode is electrolyzed in a fused salt, where low-valence titanium in the anode is dissolved into the fused salt to form $Ti^{2+}$ and $Ti^{3+}$, and $Ti^{3+}$ and $Ti^{3+}$ are precipitated at a cathode to obtain titanium.

The existing electrolysis preparation methods have the following shortcomings.

1. In the FFC process, high-purity $TiO_2$ is used as the raw material, resulting in high raw material cost, and the oxygen content of titanium prepared at the cathode may be excessive.

2. The existing anode dissolution and electrolysis methods have low production efficiency. It is discovered during research that, in the existing anode dissolution and electrolysis methods, electrolysis is first stopped after a period of time, and a cathode is intermittently taken out from a high-temperature fused salt pool; after cooling, an electrolytic tank sealing cover is opened and prepared titanium is scraped and collected; and then the cathode is installed back and used for subsequent electrolysis. Therefore, the titanium powder at the cathode cannot be continuously taken out and collected. In addition, the frequent opening of the electrolytic tank results in bad air quality in a workshop and high labor intensity for workers, and it is difficult to realize automated production.

3. The O and N contents of the titanium products may be excessive. Titanium powder easily reacts with oxygen and nitrogen in the air at a high temperature, which reduces the quality of titanium. The open operations are much more likely to cause contamination for titanium. The existing batch methods not only greatly reduce the production efficiency, but also easily lead to products with excessive O and N contents.

4. The existing technology cannot conveniently adjust an average particle size of prepared titanium powder.

Therefore, in order to improve the production efficiency of titanium powder by fused salt electrolysis, increase the purity of prepared titanium powder, and adjust an average particle size of titanium powder, the present disclosure provides a method and a device for preparing high-purity titanium powder by continuous electrolysis.

SUMMARY

In view of the above-mentioned problems, the present disclosure provides a method and a device for preparing high-purity titanium powder by continuous electrolysis.

The present disclosure adopts the following technical solutions to solve the technical problems:

The present disclosure provides a device for preparing high-purity titanium powder by continuous electrolysis, including a continuous electrolysis discharging mechanism, a filtering mechanism, a washing mechanism, and a drying mechanism, where the continuous electrolysis discharging mechanism includes an electrolytic tank body and a power source; at least one titanium-containing conductive ceramic anode and a rotatable cathode are provided inside the electrolytic tank body; a lower space below a top of the titanium-containing conductive ceramic anode in the electrolytic tank body is a fused salt chamber configured to hold a fused salt, and the remaining upper space is an inert atmosphere/vacuum environment chamber; one end of the cathode extends into the inert atmosphere/vacuum environment chamber; a side of the cathode located in the inert atmosphere/vacuum environment chamber is provided with an automatic discharging mechanism, and the automatic discharging mechanism communicates with a storage tank provided outside the electrolytic tank body; titanium powder deposited at the cathode is continuously transferred to the inert atmosphere/vacuum environment chamber, discharged by the automatic discharging mechanism, and then sent to and stored in the storage tank; a top of the electrolytic tank body is sealed by an electrolytic tank sealing cover, and the power source is electrically connected with the titanium-containing conductive ceramic anode and the cathode.

Definition: The inert atmosphere/vacuum environment means that an inert atmosphere or vacuum environment atmosphere is adopted, where "/" refers to "or". It is understood in the same way below. On an implementation site of an actual process, the adaptive selection is made according to the configuration and convenience.

Preferably, the rotatable cathode may be provided in the form of a conveyor belt, including a driving pulley provided in the inert atmosphere/vacuum environment chamber, a driven pulley at a lower part of the electrolytic tank body, and a belt-shaped cathode sleeved between the driving pulley and the driven pulley; and a driving end of the driving pulley may be coupled with an output shaft of a driving motor, and the driving motor may be electrically connected to the power source.

Preferably, there may be two titanium-containing conductive ceramic anodes oppositely provided at two sides of the cathode.

Preferably, the rotatable cathode may be provided in the form of a roller, including a driving motor, a roller shaft provided between the fused salt chamber and the inert atmosphere/vacuum environment chamber, and a roller cathode sleeved on the roller shaft; a driving end of the roller shaft may be coupled with an output shaft of the driving motor, and the driving motor may be electrically connected to the power source; and the titanium-containing conductive ceramic anode may be in an arc shape adaptive to the roller cathode.

Preferably, the automatic discharging mechanism may include a discharging scraper, a discharging hopper, and a discharging pipe. The discharging scraper may be provided obliquely and oppositely relative to an outer wall of the cathode at a given spacing, and preferably, the discharging scraper may be provided tangentially to the outer wall of the cathode at a given spacing. A specific spacing can be selected according to needs, provided that the titanium powder deposited on the outer wall of the cathode can be effectively scraped. The discharging hopper may be located at a position where the titanium powder falls. A bottom of the discharging hopper may communicate with the storage tank through the discharging pipe.

The present disclosure also provides a method for preparing high-purity titanium powder by continuous electrolysis based on the device above, including the following steps:

S1. fused salt electrolysis: energizing the titanium-containing conductive ceramic anode and the rotatable cathode in the electrolytic tank body with a fused salt for electrolysis, where the titanium-containing conductive ceramic anode has a chemical composition of $TiC_xO_y$ ($0<x\leq y\leq 1$, $x+y=1$) or $TiC_xO_yN_z$ ($0<x\leq y\leq 1$, $0<z<1$, $x+y+z=1$);

S2. continuous extraction of titanium powder: continuously transferring titanium powder reduced and deposited on a surface of the cathode to a position above the fused salt through periodic rotation movement of the rotatable cathode, and scraping the titanium powder by the automatic discharging mechanism to continuously collect the prepared titanium powder, where the titanium powder admixed with the fused salt enters the storage tank under gravity;

S3. titanium powder separation and fused salt recovery: passing the collected titanium powder admixed with the fused salt through the filtering mechanism to obtain titanium powder, and recovering the fused salt;

S4. washing by the washing mechanism: after the titanium powder is cooled, washing the titanium powder with deoxygenated and deionized water to remove residual fused salt; and S5. vacuum-drying by the drying mechanism: vacuum-drying to obtain final titanium powder.

Preferably, a method for preparing the titanium-containing conductive ceramic anode in S1 from titanium dioxide may include: mixing and grinding $TiO_2$ with an average particle size of 0.4 μm and a purity of 99% and graphite powder with an average particle size of 50 μm and a purity of 99.8% at a mass ratio of 8:2 for 2 h to 3 h in a ball mill; pressing a resulting mixture into particles with a diameter of 10 mm to 12 mm and a height of 10 mm to 12 mm under a pressure of 50 MPa to 60 MPa in a steel mold; treating the particles at 1,000° C. to 1,500° C. in an argon atmosphere or a nitrogen and argon atmosphere for 2 h to 18 h to obtain a titanium-containing conductive ceramic; and mixing and grinding the titanium-containing conductive ceramic and water in a ball mill, and subjecting a resulting mixture to press-molding in a mold and then to sintering at 1,600° C. to 1,800° C. in an argon atmosphere to obtain the titanium-containing conductive ceramic anode.

Preferably, during the fused salt electrolysis in S1, the current density at the cathode may be adjusted to control an average particle size of prepared high-purity titanium powder; the rotatable cathode may have the current density range of 0.05 A/cm$^2$ to 1.2 A/cm$^2$; and the titanium powder may have an average particle size range of 0.7 μm to 2 mm.

Preferably, in S1, the cathode surface deposited with titanium powder may be made of one or more from the group consisting of titanium, titanium alloy, carbon steel, stainless steel, aluminum, aluminum alloy, chromium, molybdenum, magnesium, and copper.

Preferably, in S1, the fused salt may include one or more from the group consisting of LiCl, NaCl, KCl, $MgCl_2$, and $CaCl_2$; a sum of $Ti^{2+}$ and $Ti^{3+}$ concentrations may be less than 8% wt, and the fused salt electrolysis may be conducted at 420° C. to 750° C.

Preferably, in S2, the periodic rotation movement of the rotatable cathode relative to the titanium-containing conductive ceramic anode is at a relative movement rate of 0 m/s to 2.5 m/s, and as the movement rate increases, the average particle size of the titanium powder decreases correspondingly; and the titanium powder may have an average particle size range of 0.7 μm to 2 mm.

Preferably, in S3, the filtering mechanism may be placed in an inert atmosphere or a vacuum environment at a temperature of 420° C. to 750° C.; and in S5, the final titanium powder may have an oxygen content of less than 0.3% wt, a carbon content of less than 0.1% wt, and an iron content of less than 0.4% wt.

The present disclosure has the following beneficial effects:

1. In the present disclosure, high-purity titanium powder is directly prepared by a one-step method, which eliminates the need for titanium smelting, purification, powdering, and other steps in a traditional method.

2. The present disclosure has high production efficiency. By the rotatable cathode, a batch electrolysis preparation method is upgraded to a continuous electrolysis preparation method, which improves the production efficiency and is suitable for industrialized large-scale production.

3. The present disclosure provides a novel method for adjusting the average particle size of titanium powder. By adjusting the rotation rate and the current density of the rotatable cathode, the average particle size of titanium powder to be prepared can be conveniently adjusted. The present disclosure is particularly suitable for the production of fine-grained titanium powder.

4. The titanium powder prepared by the present disclosure has high purity. The closed continuous operation reduces the possibility of reduced titanium to react with nitrogen and oxygen in the air, and prepared titanium powder has a higher purity than titanium powder prepared by an existing electrolysis method.

Figure 1:
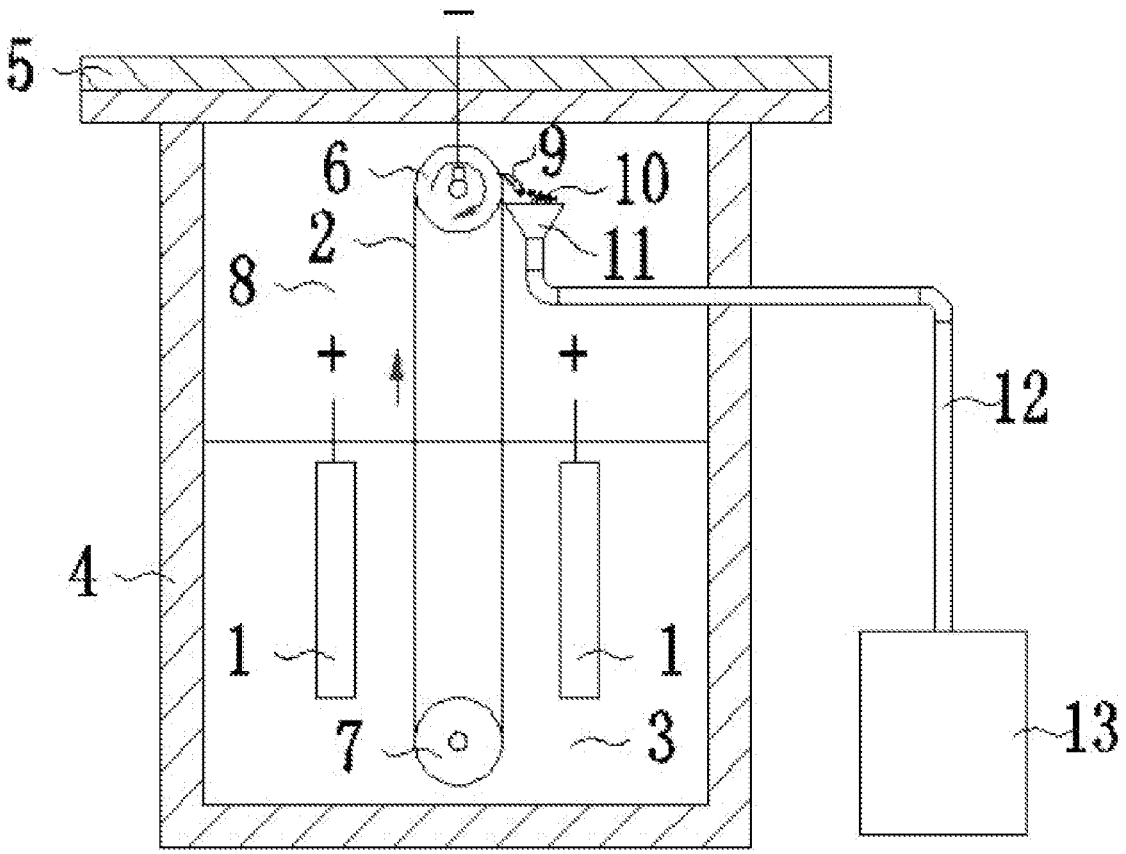
FIG. 1 is a schematic diagram illustrating the device for preparing high-purity titanium powder by continuous electrolysis that is equipped with a conveyor-belt-type rotatable cathode.

In the figures: 1 represents a titanium-containing conductive ceramic anode, 2 represents a cathode, 3 represents a fused salt chamber, 4 represents an electrolytic tank body, 5 represents an electrolytic tank sealing cover, 6 represents a driving pulley, 7 represents a driven pulley, 8 represents an inert atmosphere/vacuum environment chamber, 9 represents a discharging scraper, 10 represents titanium powder, 11 represents a discharging hopper, 12 represents a discharging pipe, 13 represents a storage tank, and 14 represents a roller cathode.

DETAILED DESCRIPTION OF THE EMBODIMENTS

The examples of the present disclosure are described in detail below, but the present disclosure can be implemented in various different modes limited and involved by the claims.

In an example, a titanium-containing conductive ceramic anode is prepared. There are various methods for preparing the titanium-containing conductive ceramic anode. The titanium-containing conductive ceramic anode used in the examples of the present disclosure is prepared by the following method: titanium dioxide (with an average particle size of 0.4 μm and 99% of $TiO_2$) and graphite powder (with an average particle size of 50 μm and a carbon content of 99.8%) are mixed and ground at a mass ratio of 8:2 for 2 h to 3 h in a ball mill, and a resulting mixture is pressed into particles with a diameter of 10 mm to 12 mm and a height of 10 mm to 12 mm under a pressure of 50 MPa to 60 MPa in a steel mold; the particles are treated at 1,000° C. to 1,500° C. in an argon atmosphere or a nitrogen and argon atmosphere for 2 h to 18 h to obtain a titanium-containing conductive ceramic with a chemical composition of $TiC_xO_y$ ($0<x\leq y\leq 1$, $x+y=1$) or $TiC_xO_yN_z$ ($0<x\leq y\leq 1$, $0<z<1$, $x+y+z=1$), where the chemical composition is determined by XRD analysis; and the titanium-containing conductive ceramic and water are mixed and ground in a ball mill, and a resulting mixture is subjected to press-molding in a mold and then to sintering at 1,600° C. to 1,800° C. in an argon atmosphere to obtain the titanium-containing conductive ceramic anode.

The device for preparing high-purity titanium powder by continuous electrolysis according to the present disclosure includes a continuous electrolysis discharging mechanism, a filtering mechanism, a washing mechanism, and a drying mechanism, where the continuous electrolysis discharging mechanism includes an electrolytic tank body 4 and a power source; at least one titanium-containing conductive ceramic anode 1 and a rotatable cathode 2 are provided inside the electrolytic tank body 4; a lower space below a top of the titanium-containing conductive ceramic anode in the electrolytic tank body 4 is a fused salt chamber 3 configured to hold a fused salt, and the remaining upper space is an inert atmosphere/vacuum environment chamber 8; one end of the cathode 2 extends into the inert atmosphere/vacuum environment chamber 8; a side of the cathode 2 located in the inert atmosphere/vacuum environment chamber 8 is provided with an automatic discharging mechanism, and the automatic discharging mechanism communicates with a storage tank 13 provided outside the electrolytic tank body 4; titanium powder deposited at the cathode 2 is continuously transferred to the inert atmosphere/vacuum environment chamber 8, discharged by the automatic discharging mechanism, and then sent to and stored in the storage tank 13; a top of the electrolytic tank body 4 is sealed by an electrolytic tank sealing cover 5; and the power source is electrically connected with the titanium-containing conductive ceramic anode 1 and the cathode 2.

Figure 2:
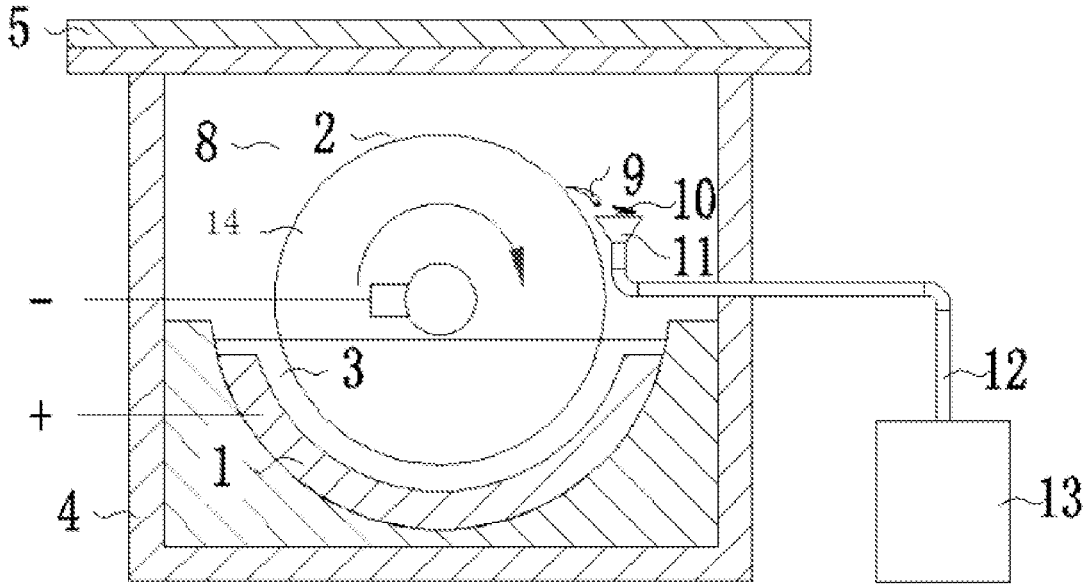
FIG. 2 is a schematic diagram illustrating the device for preparing high-purity titanium powder by continuous electrolysis that is equipped with a roller-type rotatable cathode.

As shown in FIG. 1, the rotatable cathode may be provided in the form of a conveyor belt, including a driving pulley 6 provided in the inert atmosphere/vacuum environment chamber 8, a driven pulley 7 at a lower part of the electrolytic tank body 4, and a belt-shaped cathode sleeved between the driving pulley and the driven pulley; a driving end of the driving pulley 6 may be coupled with an output shaft of a driving motor, and the driving motor may be electrically connected to the power source; and there may be two titanium-containing conductive ceramic anodes 1 oppositely provided at two sides of the cathode 2. The cathode 2 may be made of titanium, stainless steel, or the like, and may be connected to a negative electrode of the power supply through the driving pulley 6. As an equivalent solution, as shown in FIG. 2, the rotatable cathode 2 may be provided in the form of a roller, including a driving motor, a roller shaft provided between the fused salt chamber 3 and the inert atmosphere/vacuum environment chamber 8, and a roller cathode sleeved on the roller shaft; a driving end of the roller shaft may be coupled with an output shaft of the driving motor, and the driving motor may be electrically connected to the power source; and the titanium-containing conductive ceramic anode 1 may be in an arc shape adaptive to the roller cathode. It is ensured that distances between the anode and the cathode in the two cases are the same.

In the present disclosure, the automatic discharging mechanism may include a discharging scraper 9, a discharging hopper 11, and a discharging pipe 12; the discharging scraper 9 may be provided tangentially to an outer wall of the cathode 2 at a given spacing; the discharging hopper 11 may be located at a position where the titanium powder 10 falls; and a bottom of the discharging hopper 11 may communicate with the storage tank 13 through the discharging pipe 12.

In the example, after the electrolysis is completed, the titanium powder at an inner bottom of the storage tank 13 is passed through a suction filtration mechanism in an argon atmosphere, where a titanium mesh filter layer is used to separate the titanium powder under heat preservation conditions; the fused salt is recovered and returned to the electrolytic tank; then the titanium powder obtained from the filtration is cooled to below 80° C., and washed 4 times with deoxygenated and deionized water in a stirred tank to remove a small amount of residual inorganic salt; and the titanium powder is dried under vacuum to obtain final titanium powder.

Example 1

The fused salt electrolysis device equipped with a conveyor-belt-type rotatable cathode shown in FIG. 1 was used, where a titanium-containing conductive ceramic anode 1 with a chemical composition of $TiC_{0.33}O_{0.67}$ prepared by the above method was selected. The belt-shaped cathode 2 was made of SUS304 stainless steel, with a thickness of 0.5 mm. The LiCl—NaCl—KCl—$TiCl_2$—$TiCl_3$ fused salt was used as an electrolyte, with a titanium ion content of 4% wt. The inert atmosphere chamber 8 in the electrolytic tank was protected by argon, and electrolysis was conducted at 550° C. The electrolytic tank had a voltage of 4.1 V, and the current density at the cathode was 0.3 A/cm$^2$. The belt-shaped cathode had a rotation rate of 0.2 m/s. After electrolysis was conducted for 12 h, the titanium powder at the bottom of the storage tank 13 was passed through a titanium mesh filtering mechanism, and the fused salt was recovered. Then the titanium powder obtained from the filtration was cooled to below 80° C. and washed with deoxygenated and deionized water. Finally, the titanium powder was dried under vacuum conditions to obtain titanium powder.

The obtained titanium powder had an average particle size of 43 μm, and elemental analysis results of the titanium powder were as follows: Ti: 99.30%, C: 0.07%, O: 0.25%, and Fe: 0.26%. A yield of Ti was 96%, and the current efficiency of the cathode was 84%.

Examples 2 to 6

The experimental conditions in these examples were the same as in Example 1 except that a rotation rate of the belt-shaped cathode was changed. The average particle size of obtained titanium powder was as follows:

| Example | Rotation rate of rotatable cathode (m/s) | Average particle size of titanium powder (μm) |
|---|---|---|
| 2 | 0.05 | 487 |
| 3 | 0.1 | 135 |
| 4 | 0.5 | 30 |
| 5 | 1 | 13 |
| 6 | 2 | 3.5 |

Example 7

The fused salt electrolysis device equipped with a conveyor-belt-type rotatable cathode shown in FIG. 1 was used, where a titanium-containing conductive ceramic anode with a chemical composition of $TiC_{0.2}O_{0.4}N_{0.4}$ was selected. The conveyor-belt-type rotatable cathode was a Ti metal belt with a thickness of 0.3 mm. The $Ca_2Cl$—NaCl—KCl—$TiCl_2$ fused salt was used as an electrolyte, with a titanium ion content of 3% wt. Electrolysis was conducted at 670° C. The electrolytic tank had a voltage of 3.6 V, and the current density at the cathode was 0.1 A/cm$^2$. The other experimental conditions were the same as in Example 1.

The obtained titanium powder had an average particle size of 55 μm, and elemental analysis results of the titanium powder were as follows. Ti: 99.50%, C: 0.05%, O: 0.15%, and Fe: 0.07%. A yield of Ti was 97%, and the current efficiency of the cathode was 91%.

Example 8

The fused salt electrolysis device equipped with a roller-type rotatable cathode shown in FIG. 2 was used, where a titanium-containing conductive ceramic anode 1 with a chemical composition of $TiC_{0.3}O_{0.5}N_{0.2}$ was selected. The rotatable cathode 2 on the surface of the roller was made of SUS316 stainless steel, with a thickness of 1 mm. The LiCl—NaCl—$MgCl_2$—$TiCl_2$—$TiCl_3$ fused salt was used as an electrolyte, with a titanium ion content of 5% wt. The chamber 8 in the electrolytic tank was in a vacuum environment, and electrolysis was conducted at 570° C. The electrolytic tank had a voltage of 4.7 V, and the current density at the cathode was 0.4 A/cm$^2$. The roller-type rotatable cathode 14 had a rotation rate of 10 rpm. After electrolysis was conducted for 12 h, the titanium powder in the storage tank 13 was passed through a titanium mesh filtering mechanism, and the fused salt was recovered. Then the titanium powder obtained from the filtration was cooled to below 80° C. and washed with deoxygenated and deionized water. Finally, the titanium powder was dried under vacuum conditions to obtain titanium powder.

The obtained titanium powder had an average particle size of 16 μm, and elemental analysis results of the titanium powder were as follows: Ti: 99.50%, C: 0.08%, O: 0.13%, and Fe: 0.21%. A yield of Ti was 96%, and the current efficiency of the cathode was 97%.

Examples 9 to 12

The experimental conditions in these examples were the same as in Example 8 except that the current density of the roller-type rotatable cathode was changed. The average particle size of obtained titanium powder was as follows:

| Example | Current density ($A/cm^2$) | Average particle size of titanium powder (μm) |
|---|---|---|
| 9 | 0.05 | 145 |
| 10 | 0.2 | 83 |
| 11 | 0.6 | 4.2 |
| 12 | 0.8 | 2 |

The above examples are merely preferred examples of the present disclosure and are not intended to limit the present disclosure, and various changes and modifications may be made to the present disclosure by those skilled in the art. Any modifications, equivalent substitutions, improvements and the like made within the spirit and principles of the present disclosure are intended to be included in the protection scope of the present disclosure.

What is claimed is:

1. A device for preparing high-purity titanium powder by continuous electrolysis, comprising a continuous electrolysis discharging mechanism, a filtering mechanism, a washing mechanism, and a drying mechanism, wherein the continuous electrolysis discharging mechanism comprises an electrolytic tank body;

at least one titanium-containing conductive ceramic anode and a rotatable cathode are provided inside the electrolytic tank body, wherein the at least one titanium-containing conductive ceramic anode is prepared by the following steps:

mixing and grinding $TiO_2$ with an average particle size of 0.4 μm and a purity of 99% and graphite powder with an average particle size of 50 μm and a purity of 99.8% at a mass ratio of 8:2 for 2 h to 3 h in a ball mill to obtain a first resulting mixture, pressing the first resulting mixture into particles with a diameter of 10 mm to 12 mm and a height of 10 mm to 12 mm under a pressure of 50 MPa to 60 MPa in a steel mold, treating the particles at 1,000° C. to 1,500° C. in an argon atmosphere or a nitrogen and argon atmosphere for 2 h to 18 h to obtain a titanium-containing conductive ceramic, mixing and grinding the titanium-containing conductive ceramic and water in the ball mill to obtain a second resulting mixture, and subjecting the second resulting mixture to press-molding in a mold and then to sintering at 1.600° C. to 1.800° C. in the argon atmosphere to obtain the at least one titanium-containing conductive ceramic anode;

a lower space below a top of the at least one titanium—containing conductive ceramic anode—in the electrolytic tank body is a fused salt chamber configured to hold a fused salt, and the remaining upper space is an inert atmosphere/vacuum environment chamber;

one end of the rotatable cathode extends into the inert atmosphere/vacuum environment chamber;

a side of the rotatable cathode located in the inert atmosphere/vacuum environment chamber—is provided with an automatic discharging mechanism, and the automatic discharging mechanism communicates with an inert atmosphere/vacuum environment storage tank provided outside the electrolytic tank body;

titanium powder deposited at the rotatable cathode is continuously transferred to the inert atmosphere/vacuum environment chamber, discharged by the automatic discharging mechanism, and then sent to and stored in the inert atmosphere/vacuum environment storage tank;

a top of the electrolytic tank body is sealed by an electrolytic tank sealing cover;

the device further comprises a power source, wherein the power source is electrically connected with the at least one titanium-containing conductive ceramic anode and the rotatable cathode.

2. The device according to claim 1, wherein the rotatable cathode is a conveyor belt, comprising a driving pulley provided in the inert atmosphere/vacuum environment chamber, a driven pulley at a lower part of the electrolytic tank body, and a belt-shaped cathode sleeved between the driving pulley and the driven pulley;

a driving end of the driving pulley is coupled with an output shaft of a driving motor, and the driving motor is electrically connected to the power source; and the at least one titanium-containing conductive ceramic anode is two titanium-containing conductive ceramic anodes oppositely provided at two sides of the rotatable cathode.

3. The device according to claim 1, wherein the rotatable cathode is a roller, comprising a driving motor, a roller shaft provided between the fused salt chamber and the inert atmosphere/vacuum environment chamber, and a roller cathode sleeved on the roller shaft;

a driving end of the roller shaft is coupled with an output shaft of the driving motor, and the driving motor is electrically connected to the power source; and the at least one titanium-containing conductive ceramic anode is in an arc shape adaptive to the roller cathode.

4. The device according to claim 1, wherein the automatic discharging mechanism comprises a discharging scrape, a discharging hopper, and a discharging pipe; the discharging scraper is provided obliquely and oppositely relative to an outer wall of the rotatable cathode at a given spacing;

the discharging hopper is located at a position where the titanium powder falls; a bottom of the discharging hopper communicates with the inert atmosphere/vacuum environment storage tank-through the discharging pipe; and the discharging scraper is tangential to the outer wall of the rotatable cathode.

5. A method for preparing high-purity titanium powder by continuous electrolysis based on the device according to claim 1, comprising the following steps:

S1. fused salt electrolysis: energizing the at least one titanium-containing conductive ceramic anode and the rotatable cathode in the electrolytic tank body with the fused salt for electrolysis, wherein the at least one titanium-containing conductive ceramic anode has a chemical composition of $TiC_xO_y$ ($0<x\leq y\leq 1$, $x+y=1$) or $TiC_xO_yN_z$ ($0<x\leq y\leq 1$, $0<z<1$, $x+y+z=1$);

S2. continuous extraction of titanium powder: continuously transferring the titanium powder reduced and deposited on a surface of the rotatable cathode to a position above the fused salt through periodic rotation movement of the rotatable cathode, and scraping the titanium powder by the automatic discharging mechanism to continuously collect scraped titanium powder, wherein the scraped titanium powder admixed with the fused salt enters the storage tank under gravity;

S3. titanium powder separation and fused salt recovery: passing the scraped titanium powder admixed with the fused salt through the filtering mechanism to obtain filtered titanium powder, and recovering the fused salt;

S4. washing by the washing mechanism: after the filtered titanium powder is cooled, washing the filtered titanium powder with deoxygenated and deionized water to remove residual fused salt; and S5. vacuum-drying by the drying mechanism: vacuum-drying to obtain final titanium powder.

6. The method according to claim 5, wherein during the fused salt electrolysis in S1, a current density at the rotatable cathode is adjusted to control an average particle size of prepared high-purity titanium powder; the rotatable cathode has a current density range of 0.05 $A/cm^2$ to 1.2 $A/cm^2$, and the titanium powder has an average particle size range of 0.7 μm to 2 mm.

7. The method according to claim 5, wherein in S2, the surface of the rotatable cathode deposited with titanium powder is made of one or more from the group consisting of titanium, titanium alloy, carbon steel, stainless steel, aluminum, aluminum alloy, chromium, molybdenum, magnesium, and copper.

8. The method according to claim 5, wherein in S1, the fused salt comprises one or more from the group consisting of LiCl, NaCl, KCl, $MgCl_2$, and $CaCl_2$; a sum of $Ti^{2+}$ and $Ti^{3+}$ concentrations is less than 8% wt; and the fused salt electrolysis is conducted at 420° C. to 750° C.

9. The method according to claim 5, wherein in S2, the periodic rotation movement of the rotatable cathode relative to the at least one titanium-containing conductive ceramic anode is at a relative movement rate of 0 m/s to 2.5 m/s, and as the movement rate increases, the average particle size of the titanium powder decreases correspondingly; and the titanium powder has an average particle size range of 0.7 μm to 2 mm.

10. The method according to claim 5, wherein in S3, the filtering mechanism is placed in an inert atmosphere or a vacuum environment at a temperature of 420° C. to 750° C.; and in S5, the final titanium powder has an oxygen content of less than 0.3% wt, a carbon content of less than 0.1% wt, and an iron content of less than 0.4% wt.

11. The method according to claim 5, wherein the rotatable cathode is a conveyor belt, comprising a driving pulley provided in the inert atmosphere/vacuum environment chamber, a driven pulley at a lower part of the electrolytic tank body, and a belt-shaped cathode sleeved between the driving pulley and the driven pulley;

a driving end of the driving pulley is coupled with an output shaft of a driving motor, and the driving motor is electrically connected to the power source; and the at least one titanium-containing conductive ceramic anode is two titanium-containing conductive ceramic anodes oppositely provided at two sides of the rotatable cathode.

12. The method according to claim 5, wherein the rotatable cathode is a roller, comprising a driving motor, a roller shaft provided between the fused salt chamber and the inert atmosphere/vacuum environment chamber, and a roller cathode sleeved on the roller shaft;

a driving end of the roller shaft is coupled with an output shaft of the driving motor, and the driving motor is electrically connected to the power source; and the at least one titanium-containing conductive ceramic anode is in an arc shape adaptive to the roller cathode.

13. The method according to claim 5, wherein the automatic discharging mechanism comprises a discharging scraper, a discharging hopper, and a discharging pipe; the discharging scraper is provided obliquely and oppositely relative to an outer wall of the rotatable cathode at a given spacing;

the discharging hopper is located at a position where the titanium powder falls; a bottom of the discharging hopper communicates with the inert atmosphere/vacuum environment storage tank through the discharging pipe; and the discharging scraper is tangential to the outer wall of the rotatable cathode.

* * * * *